US009976245B2

(12) United States Patent
Deppermann et al.

(10) Patent No.: US 9,976,245 B2
(45) Date of Patent: May 22, 2018

(54) METHOD FOR OPERATING A DISPENSING SYSTEM FOR A WASHING MACHINE, DISPENSING SYSTEM, AND WASHING MACHINE

(75) Inventors: Thomas Deppermann, Guetersloh (DE); Michael Finke, Hoevelhof (DE); Olaf Witte, Detmold (DE)

(73) Assignee: MIELE & CIE. KG, Guetersloh (DE)

( * ) Notice: Subject to any disclaimer, the term of this patent is extended or adjusted under 35 U.S.C. 154(b) by 2425 days.

(21) Appl. No.: 12/252,832

(22) Filed: Oct. 16, 2008

(65) Prior Publication Data

US 2009/0095027 A1 Apr. 16, 2009

(30) Foreign Application Priority Data

Oct. 16, 2007 (DE) ..... 10 2007 049 723

(51) Int. Cl.

| | |
|---|---|
| ***D06F 33/02*** | (2006.01) |
| ***D06F 39/02*** | (2006.01) |
| ***D06F 35/00*** | (2006.01) |
| ***D06F 39/00*** | (2006.01) |

(52) U.S. Cl.

CPC ..... *D06F 39/02* (2013.01); *D06F 33/02* (2013.01); *D06F 35/00* (2013.01); *D06F 39/005* (2013.01)

(58) Field of Classification Search

CPC ..... D06F 33/02; D06F 35/00; D06F 39/005; D06F 39/02

USPC ..... 68/17 R; 134/18, 56 R, 57 R; 222/52, 222/132, 129, 144.5

See application file for complete search history.

(56) References Cited

U.S. PATENT DOCUMENTS

| | | | | |
|---|---|---|---|---|
| 6,629,439 | B2 * | 10/2003 | Wobkemeier | 68/12.02 |
| 2003/0116177 | A1 | 6/2003 | Appel et al. | |
| 2006/0107705 | A1 | 5/2006 | Hsu et al. | |
| 2007/0044819 | A1 | 3/2007 | Chan et al. | |

FOREIGN PATENT DOCUMENTS

| | | | |
|---|---|---|---|
| DE | 1435031 | A1 | 10/1968 |
| DE | 3303292 | A1 | 5/1984 |
| DE | 3901686 | | 7/1990 |
| DE | 4421518 | A1 | 12/1995 |
| DE | 10039408 | A1 | 12/2001 |

(Continued)

OTHER PUBLICATIONS

Koester, Ardis, "Selecting and Using Laundry Aids", Oregon State University Extension Service, Jan. 1989.*

(Continued)

*Primary Examiner* — Douglas Lee

(74) *Attorney, Agent, or Firm* — Leydig, Voit & Mayer, Ltd.

(57) ABSTRACT

A method of operating a dispensing system for a washing machine including a suds container for receiving wash liquid and at least one supply container for receiving a treating agent. The method includes selecting and activating a wash or treatment cycle from a plurality of wash or treatment cycles using an input device. The treating agent for delivery to the suds container is selected based on suitability information corresponding to the selected wash or treatment cycle. The treating agent is delivered to the suds container at the start of the activated wash or treatment cycle. The activated wash or treatment cycle is performed using a controller.

7 Claims, 5 Drawing Sheets

(56) References Cited

FOREIGN PATENT DOCUMENTS

| | | | |
|---|---|---|---|
| DE | 10062111 | C1 | 7/2002 |
| DE | 10148454 | A1 | 7/2003 |
| DE | 102006009807 | | 9/2007 |
| EP | 611159 | A1 * | 8/1994 |
| EP | 0844326 | A1 | 5/1998 |
| EP | 1318225 | | 6/2003 |
| GB | 2134078 | A * | 8/1984 |
| WO | WO 0032864 | A2 * | 6/2000 |

OTHER PUBLICATIONS

Miele Softtronic "Gebrauchsanweisung Waschautomat W 4449 WPS LiquidWash"; M-Nr. 06 651 480 [Miele Honeycomb Care "Operating instructions for Washing machine W 4449 WPS LiquidWash" M-Nr. 06 732 380].

Miele "Elektrogeraete fuer Haushalt und Kleingewerbe", programm survey, status: Mar. 1, 2007.

* cited by examiner

METHOD FOR OPERATING A DISPENSING SYSTEM FOR A WASHING MACHINE, DISPENSING SYSTEM, AND WASHING MACHINE

CROSS REFERENCE TO RELATED APPLICATIONS

Priority is claimed to German patent application DE 10 2007 049 723.9, filed Oct. 16, 2007, which is hereby incorporated by reference herein.

FIELD

The present invention relates to a method for operating a dispensing system for a washing machine including a suds container for receiving wash liquid, at least one supply container for holding a treating agent, such as detergent or washing or rinse additives, and an input means for selecting and activating the wash or treatment cycle.

BACKGROUND

In washing machines for domestic use, the detergent is usually manually introduced into a chamber and flushed with water into the suds container after the wash cycle has started. The user must observe the dosage instructions for the particular detergent used, and take care to fill the correct amount into the chamber. To facilitate charging with detergent or other additives, such as fabric softeners, automatic dispensing systems in which a relatively large amount of detergent is stored in a supply container may be used. Once a wash cycle is started, the preset amount of detergent will then be added to the wash liquid, which eliminates the need for the user to ensure that the proper amount of detergent is filled in each time a wash cycle is carried out. Such dispensing systems are frequently used especially in industrial washing machines.

German document DE 39 01 686 A1 describes a washing machine having a dispensing system for liquid detergents, in which the type of treating agent can be preset. In that document, a pump pumps the treating agent, which may, for example, be liquid detergent, from the supply container into the suds container, the user having to preset the amount to be dispensed. When the user fills the supply container with fabric softener in place of detergent, he/she must inform the controller accordingly by operating a lever, so that the treating agent will not be pumped into the suds container until the rinse step.

Another dispensing system for liquid additives is a Miele washing machine named W 4449 Liquid Wash, which has been sold since the beginning of 2006. In that washer, a supply container for liquid detergents is located outside the washing machine and connected thereto via a hose line. Disposed within the washing machine is the metering pump, which delivers the liquid or viscous detergent through a hose line to the lower region of the suds container. The metering pump is controlled by the washing machine controller which, based on the ON-time, determines the amount of detergent to be dispensed at any one time. A reference amount is preset in accordance with the detergent manufacturer's dosage instructions. In order to activate the automatic dispensing feature, the user sets the soil level, and operates an additional control handle, the soil level setting being taken into account when determining the amount of detergent to be dispensed.

DE 10 2006 009 807 A1 describes that a treating agent for a washing machine can be mixed individually. To this end, the washing machine includes a dispensing system in which the individual active substances are stored in separate containers. The dispensing system operates such that, at any one time, a particular treating agent is mixed from a plurality of individual active substances, and dispensed into the suds container, according to the soil level and the type of laundry to be washed. A method involving such a level of complexity is not very suitable in a domestic environment, because the manufacture or mixing of detergents from individual active substances is a task which only a particularly qualified person can be expected to accomplish.

European document EP 1 318 225 A1 describes a dispensing system in which the treating agents are delivered to the washing machine according to the status of the wash cycle. To this end, the time or wash cycle status at which a particular agent is dispensed is permanently defined, resulting in a fixed association of the respective agents.

These methods of operating a dispensing system require the user to consciously activate the dispensing system or, alternatively, to fill the detergent compartment with detergent or treating agent, prior to activating the wash cycle. To do this, the user must always know, and take into account, which detergent is suitable for a particular load of laundry to be washed.

SUMMARY

An aspect of the present invention is to make automatic dispensing more reliable and easier for the user.

In an embodiment, the present invention provides a method of operating a dispensing system for a washing machine including a suds container for receiving wash liquid and at least one supply container for receiving a treating agent. The method includes selecting and activating a wash or treatment cycle from a plurality of wash or treatment cycles using an input device. The treating agent for delivery to the suds container is selected based on suitability information corresponding to the selected wash or treatment cycle. The treating agent is delivered to the suds container at the start of the activated wash or treatment cycle. The activated wash or treatment cycle is performed using a controller.

BRIEF DESCRIPTION OF THE DRAWINGS

An exemplary embodiment of the present invention is shown in the drawings in a purely schematic way and will be described in more detail below. In the drawings.

DETAILED DESCRIPTION

Figure 1:
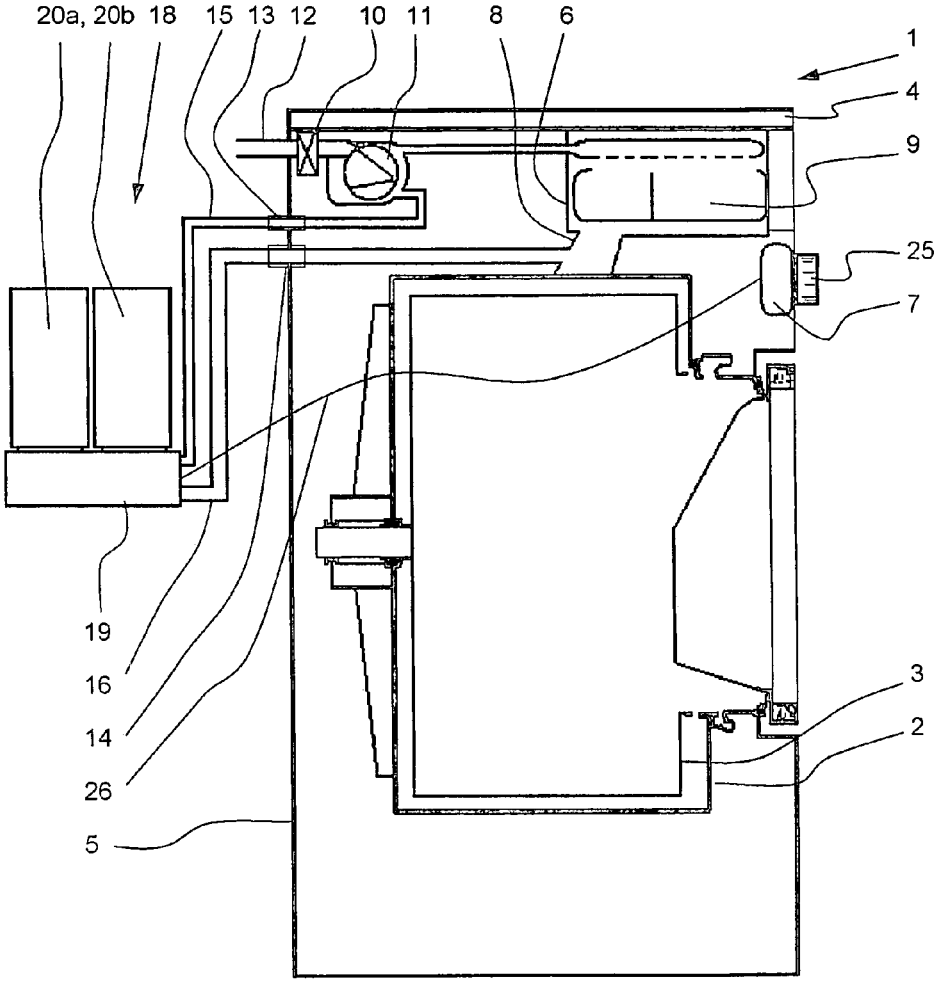
FIGS. 1 and 2 are schematic views of a washing machine having a dispensing system connected thereto.

The present invention relates to a method for operating a dispensing system for a washing machine including a suds container for receiving wash liquid, at least one supply container for holding a treating agent, such as detergent, washing additives or rinse additives, and further including an input device for selecting and activating the wash or treatment cycle, and a controller for performing the activated wash or treatment cycle, the treating agent being delivered to the suds container at the start of the activated wash cycle or treatment cycle.

The present invention further relates to a dispensing system for a washing machine, including at least one supply container for holding a treating agent, such as detergent or washing or rinse additives, and further including an input means for selecting and activating the treating agent contained in the supply container, and a controller which is used to perform the aforementioned method and is in operative connection with a controller of the washing machine, and yet further including at least one connecting conduit through which the treating agent can be delivered to the suds container of the washing machine.

The present invention also relates to a washing machine including a suds container for receiving wash liquid and a controller, and further including a dispensing system which is in operative connection with the controller of the washing machine, and at least one connecting conduit through which the treating agent can be delivered to the suds container of the washing machine, the controller of the washing machine being adapted to perform the aforementioned method for operating the dispensing system.

The present invention provides increased convenience and improved reliability in terms of washing results. The user no longer needs to check which treating agent is best suited for a particular load of laundry to be washed, each time a wash cycle is carried out. Moreover, it is ensured that special types of detergents or treating agents can be used for special treatments.

In an embodiment of the invention, the treating agent to be dispensed from the supply container is selected based on suitability information for the particular wash or treatment cycle chosen. Thus, the type of laundry to be washed or treated is determined when selecting the wash cycle or programmed sequence of wash steps.

In an embodiment, one set of suitability information is provided for each treating agent received in the supply container, said set of suitability information including a discrete piece of suitability information for each wash or treatment cycle, said discrete piece of suitability information being used in the selection of the treating agent to be dispensed. This ensures that as many as possible of the factors influencing the suitability for a particular load of laundry to be washed are taken into account.

In an embodiment, automatic dispensing from one of the supply containers is not effected until the suitability information at least reaches a threshold value for the selected wash or treatment cycle. If the suitability information is rated using a scale from 1 to 6, for example, with 1 standing for "very suitable" and 6 standing for "unsuitable", then the threshold value may be selected to be 3. This means that the detergent will automatically be dispensed for all wash cycles for which the suitability rating is 3 or better. Automatic dispensing from one of the supply containers is not effected if the suitability information does not reach a threshold value for the selected wash or treatment cycle. When using the aforementioned rating scale of grades, no detergent would be automatically dispensed for wash cycles for which the suitability rating is worse than 3, i.e., greater than 3. In this manner, the load of laundry to be washed is protected from damage caused by unsuitable treating agents. At least, it is ensured that a detergent with reduced washing performance will be used, thus avoiding unnecessarily high levels of contamination in the waste water.

In an embodiment, if the suitability information communicates to the controller that no suitability exists for the selected wash or treatment cycle, the user will be informed accordingly. This allows the user to add a suitable detergent to the washing machine in a different way, such as via the detergent dispensing drawer, or with a dispenser ball placed into the drum.

In an embodiment, the dispensing system includes at least two supply containers for respectively holding a treating agent, such as detergent or washing or rinse additives; a discrete piece of suitability information for each wash or treatment cycle being stored for each of the detergents received in the supply containers, said discrete piece of suitability information being used in the selection of the treating agent to be dispensed. Thus, a multiplicity of different possible loads of laundry can automatically receive detergent from the dispensing system, since each supply container can be filled with a different treating agent, each having a separate set of suitability information associated therewith.

In an embodiment, the suitability information for the treating agent in the first supply container is compared with the suitability information for the treating agent in the second supply container, whereupon the container is selected for which the available suitability information for the selected treatment cycle is better. Thus, the user no longer needs to bother about selecting a container, which makes laundering much easier for him/her. Improper dispensing is nearly impossible.

In an embodiment, the suitability information for the selected supply container is presented to the user as a suggestion; the activation of the selected container, or of the container that has not been selected, being effected upon confirmation by the user. Thus, the user is still able to intervene, i.e., to disable automatic dispensing, if he/she wishes to use a different treating agent than that contained in the supply containers. This may be the case especially when the suitability information is just near the threshold value, so that suitability does indeed exist, but the suitability level is not optimal for the load of laundry to be treated. The user may also activate the supply container that contains the less suitable detergent. However, this is only permitted if the suitability information for the container containing the less suitable detergent at least reaches the predetermined threshold value for the selected wash or treatment cycle.

In some cases, the user may wish to wash or treat a load of laundry for which no suitable treating agent is available in the dispensing system. In such cases, automatic dispensing from one of the supply containers is not effected if the suitability information does not reach the threshold value for the selected wash or treatment cycle. Threshold considerations are analogous to those described above.

In an embodiment, a discrete piece of suitability information is stored for each wash or treatment cycle for a treating agent in a set of suitability information, so that all selectable wash or treatment cycles, and thus all types of laundry to be treated, can be taken into account.

In order to simplify the input of suitability information, a plurality of previously stored sets of suitability information can be selected or activated by the user during the loading operation. In particular, sets of suitability information can be stored for heavy-duty powdered detergent, powdered detergent for colored fabrics, powdered detergent for delicate fabrics, powdered detergent for wool, heavy-duty liquid detergent, liquid detergent for colored fabrics, liquid detergent for delicate fabrics, and liquid detergent for wool, and to offer said sets of suitability information for selection as needed. In this manner, the most frequently used detergents and treating agents can be used in the dispensing system with the aid of the suitability information.

In one embodiment, the suitability information can be modified and stored at a later time when detergents are used which have different suitability characteristics than those known today.

A washing machine according to the present invention that is capable of carrying out the above-described method has a housing including a rear wall which is provided with a connection for water supply to the solenoid valve and/or to the water distributor. In an embodiment, the rear wall is also provided with the connection for the water to the dispensing system and the connection for the detergent solution that is deliverable from the dispensing system. In this manner, a dispensing system in which the detergent or treating agent can be pre-mixed to form a concentrated detergent solution can be connected to the washing machine and integrated into the wash cycle or sequence of steps of a wash cycle.

In another embodiment, the washing machine has a dispensing system including at least one supply container from which the treating agent can be delivered by a pump through a conduit to the dispensing drawer or to the suds container of the washing machine. This connection option is particularly suited for a variety of different treating agents because only one hose connection may be provided on the washing machine for the treating agents. This may be especially advantageous in industrial washing machines, because such machines frequently use large containers of liquid detergent or treating agents from where the detergent or treating agent is dispensed through dip tubes inserted therein.

Referring to FIG. 1, the illustrated washing machine 1 includes a suds container 2 in which is rotatably mounted a drum 3 which is driven by an electric motor. Dispensing system 18 is located outside washing machine 1 and connected thereto via connecting hoses 15, 16. The additives used may be, for example, liquid, powdered, or granular detergents, or washing additives, such as fabric softener. Dispensing system 18, which is separate from washing machine 1, may be placed and secured at different locations, as desired. Depending on the installation conditions of washing machine 1, the dispensing system may be placed or secured, for example, on housing 4 of washing machine 1, laterally adjacent thereto, or behind it. Washing machine 1 further includes a dispensing drawer 6 which may include a detergent compartment 9 for receiving the detergent for a wash cycle and which is connected to suds container 2 via a flexible tube 8. Dispensing drawer 6 is in communication with a water feed line 12, with a solenoid valve 10 and/or a water distributor 11 interposed therebetween, which is controllable by a controller 7, said dispensing drawer allowing detergent for a single wash cycle to be flushed into suds container 2 when dispensing system 18 is not used.

In order for detergent to be added from external dispensing system 18, water is supplied thereto via supply hose 15. The detergent/water mixture, i.e. the concentrated detergent solution, is delivered to washing machine 1 through detergent solution conduit 16, the rear wall 5 of washing machine 1 being provided with a connector 13 for water conduit 15 and with a connector 14 for detergent solution conduit 16, which opens into flexible tube 8 on suds container 2 within washing machine 1. The detergent solution conduit may alternatively be connected directly to the suds container or to detergent dispensing drawer 6. In this embodiment, solenoid valve 10, water distributor 1 1, and dispensing system 18 are controlled by controller 7 of washing machine 1, which also controls the wash cycle sequence. The wash cycle is selected using an input 25, such as a control handle or a switch; and is started using this control handle 25 or an additional control handle. Dispensing system 18 is operatively connected to controller 7 via signal connection 26. The dispensing system 18 of this embodiment includes a base unit 19, a container 20*a* for a powdered or granular detergent, and a container 20*b* for a liquid or viscous detergent or treating agent.

Figure 2:
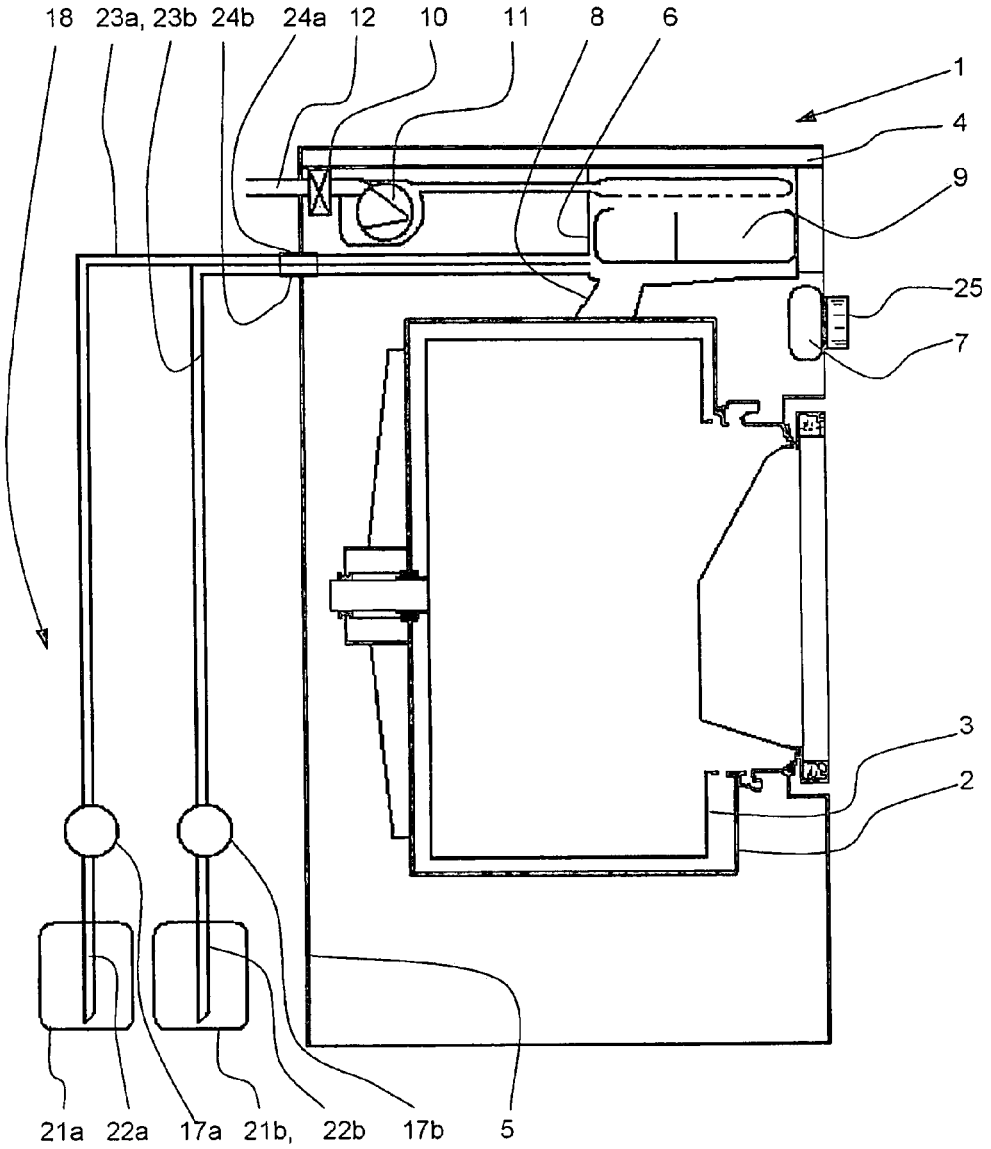

FIG. 2 shows, in a side view, a washing machine 1 including a suds container 2 in which is rotatably mounted a drum 3 which is operatively connected to an electric motor, said washing machine having a dispensing system 18 of different design. Washing machine 1 further includes a dispensing drawer 6 which may include a detergent compartment 9 for receiving the detergent for a wash cycle and which is connected to suds container 2 via a flexible tube 8. Dispensing drawer 6 is in communication with a water feed line 12, with a solenoid valve 10 and/or a water distributor 11 interposed therebetween, which is controllable by a controller 7, said dispensing drawer allowing detergent for a single wash cycle to be flushed into suds container 2 when dispensing system 18 is not used.

The supply of detergent from external dispensing system 18 is accomplished by an external feeding means which delivers the liquid detergent into dispensing drawer 6. In the example shown, two metering pumps 17*a*, 17*b* which are controlled by controller 7 of washing machine 1 and are connected by dip tubes or lances 22*a*, 22*b* to separate detergent supply containers 21*a*, 21*b*, respectively; the lances 22*a*, 22*b* extending into their respective containers 21*a*, 21*b*. Pumps 17*a*, 17*b* each have a conduit 23*a*, 23*b* connected thereto on the pressure side, said conduits connecting to dispensing drawer 6. Rear wall 5 of appliance housing 4 is provided with connection means 24*a*, 24*b*, one for each of the conduits 23*a*, 23*b*.

Figure 3:
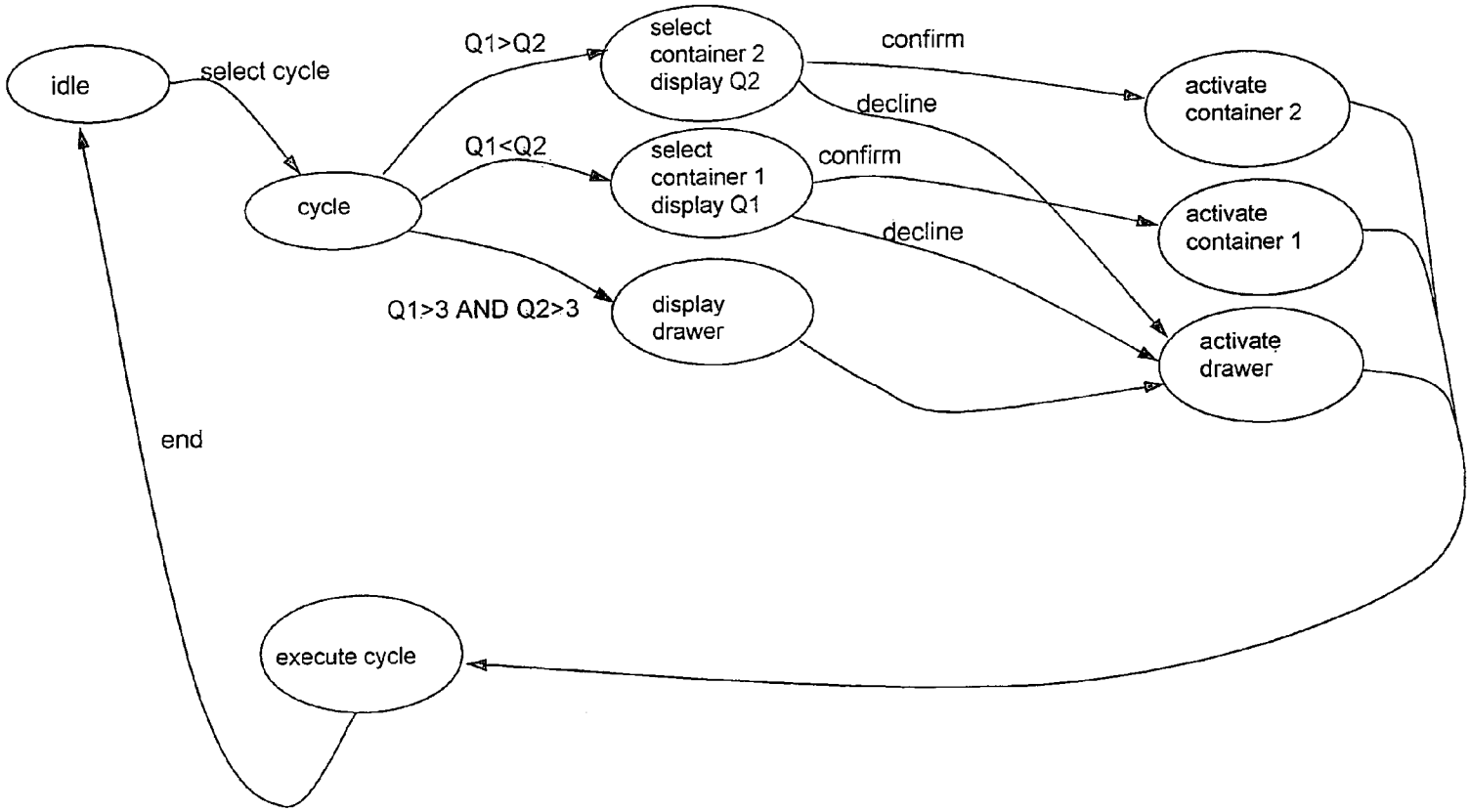
FIG. 3 is a state diagram illustrating the sequence of operation of the method according to the present invention.

FIG. 3 illustrates, in a state diagram, the sequence of operation of the method of the present invention. Upon activation of appliance 1, the controller is in an idle state (idle) and awaits the selection of a wash cycle. Once a wash cycle has been selected (select cycle), the system changes to the respective wash cycle or treatment cycle. The suitability information Q1 that is available for the treating agent contained in first supply container 20*a* (FIG. 1) or 21*a* (FIG. 2) and applies to the selected treatment cycle is compared with the suitability information Q2 for the treating agent contained in second supply container 20*b* (FIG. 1) or 21*b* (FIG. 2). When using a rating scheme, for example, the suitability level indicated by a smaller value is higher than that represented by a greater value. If the suitability information Q1 for the first supply container indicates a greater value than the suitability information Q2 for the second supply container, then the second supply container 20*b* (FIG. 1) or 21*b* (FIG. 2) is selected for dispensing (select container 2). If the suitability information Q1 for the first supply container indicates a smaller value than the suitability information Q2 for the second supply container, then the first supply container 20*a* (FIG. 1) or 21*a* (FIG. 1) is selected for dispensing (select container 1). If the suitability information for both supply containers exhibits a value greater than 3 (Q1>3 AND Q2>3), then the detergent dispensing drawer is selected and activated in place of one of the two supply containers (activate drawer). In this case, dispensing system 18 (FIG. 1, 2) is not used; i.e., none of the two supply containers is selected or activated, which is indicated to the user via a display means (display drawer), so that the user may fill a different detergent or treating agent into the detergent dispensing drawer. If one of the two supply containers has been selected, then suitability information Q1, Q2 to this effect is displayed, allowing the user to confirm or decline automatic dispensing. If the proposed automatic dispensing mode is confirmed, then the selected supply container is activated by a start command, such as by operating a start button (activate container 1, activate container 2), whereupon the wash cycle is switched to a cycle execution state (execute wash cycle). Once the wash cycle is completed (end), the washing machine; i.e., the controller, is in the idle state again (idle) and is ready for the selection of the next wash cycle or treatment cycle. If the user rejects the proposed supply container (decline), then the system activates detergent supply via the detergent dispensing drawer (activate drawer) and deactivates automatic dispensing via the dispensing system. In another embodiment, the user can select the other container, if the associated suitability information Q1, Q2 at least reaches threshold value G.

Figure 4:
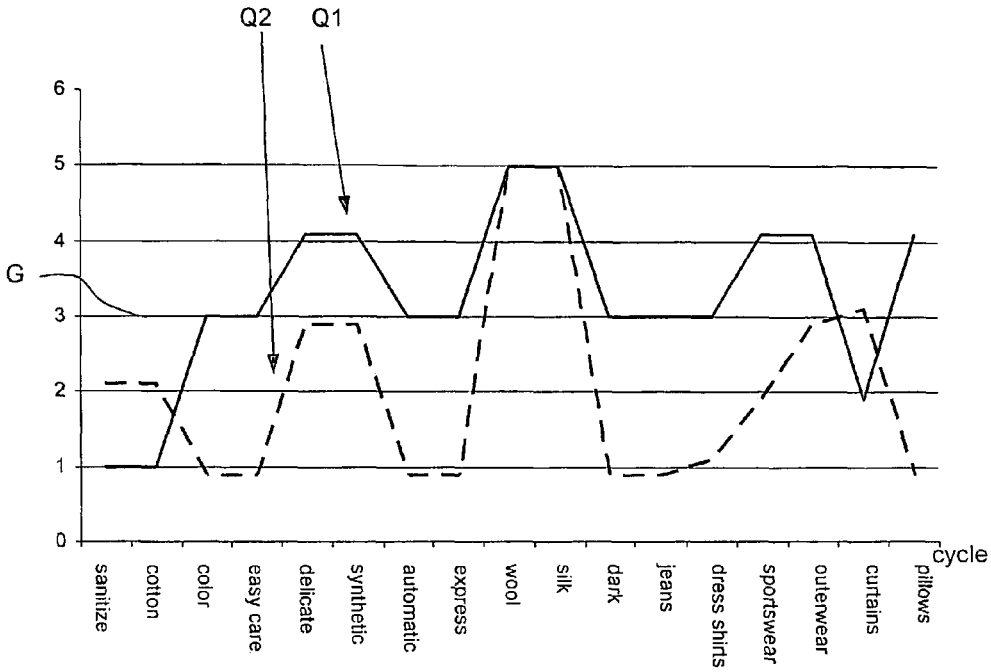
FIG. 4 is a diagram illustrating the suitability information Q1 for the first container and the suitability information Q2 for the second container.

In FIG. 4, the suitability information Q1 for first container 20*a*, 21 a (FIG. 1, FIG. 2) and Q2 for second container 20*b*, 21b (FIG. 1, FIG. 2) is represented in a diagram. For each container, the suitability information for all selectable wash cycles or treatment cycles is combined into a set of suitability information. The continuous line represents the suitability information Q1 for first container 20*a*, 21*a* (FIG. 1, FIG. 2), while the dashed line represents the suitability information Q2 for second container 20*b*, 21*b* (FIG. 1, FIG. 2). It can clearly be seen that for the "sanitize" and "cotton" wash cycles, the treatment agent in the first container is rated Q1=1 and, therefore, is better suited than the treating agent in the second container, which is rated Q2=2.1. For the "colors", "easy care", "delicates", "synthetics", "automatic", and "express" wash cycles, the treating agent in the second container is better suited. For "wool" and "silk", the suitability information for the two containers is Q1=5 and Q2=5. Accordingly, they are rated unsuitable because they exceed the threshold value G=3. If such a selection were made, none of the two containers would be activated, so that the detergent would be added via the detergent dispensing drawer. The agent filled into first container 20*a* (FIG. 1) is a heavy-duty powdered detergent, whereas the second container 20*b* (FIG. 1) was filled with a liquid detergent for colored fabrics. The agent in second container 20*b* (FIG. 1) is better suited for the remaining selectable wash cycles, namely "dark laundry", "jeans", "dress shirts", "sportswear", "outerwear", and "pillows". For curtains, the treating agent in first container 20*a* (FIG. 1) has the suitability information Q1=1.9, and is therefore better suited. In the embodiment in which the selected container is proposed to the user and is activated for the wash cycle only upon confirmation, the first container is proposed when the "cotton" wash cycle is selected, because the detergent is rated Q=1 for this wash cycle. The user can either accept this or select second container 20*b* (FIG. 1), which contains a detergent rated Q2=2.1. The second container is activated for this wash cycle, since suitability information Q2 is still better than the threshold value G=3. For the "delicates" and "synthetics" wash cycles, the second container 20*b* (FIG. 1) is proposed, because the detergent is rated Q=2.9, and thus better than the detergent in first container 20*a* (FIG. 1). The user can either accept this or choose to add the detergent via the dispensing drawer. It is not possible to select or activate first container 20*a* (FIG. 1), because the detergent contained therein is rated Q1=4.1 and is therefore worse than the threshold value G=3. Thus, the detergent in the first container is completely unsuitable and, therefore, this selection is either rejected or not provided as a selectable option to the user.

Figure 5:
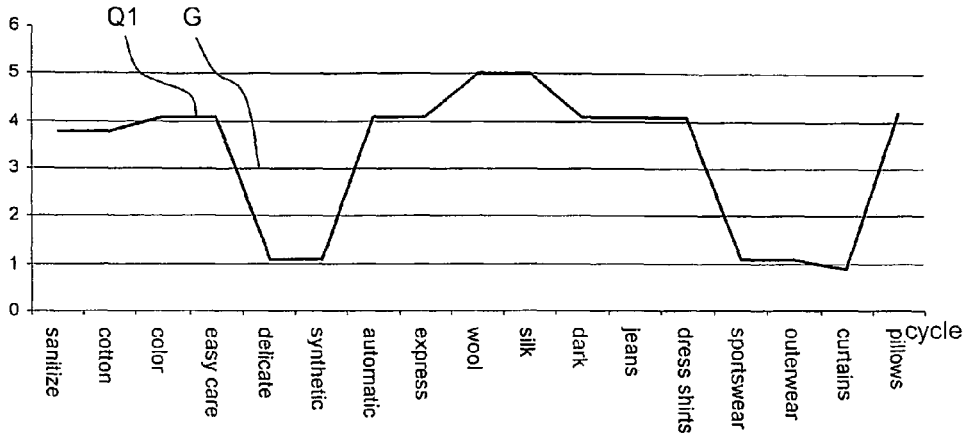
FIGS. 5 and 6 are diagrams showing sets of suitability information Q1 for different detergents.

In FIG. 5, a set of suitability information Q1 for powdered detergent for delicate fabrics is represented in a diagram. It can clearly be seen that this detergent is particularly suitable for the "delicates", "synthetics", "sportswear", "outerwear" and "curtains" wash cycles, since the suitability rating is about Q1=1 for all of these cycles.

Figure 6:
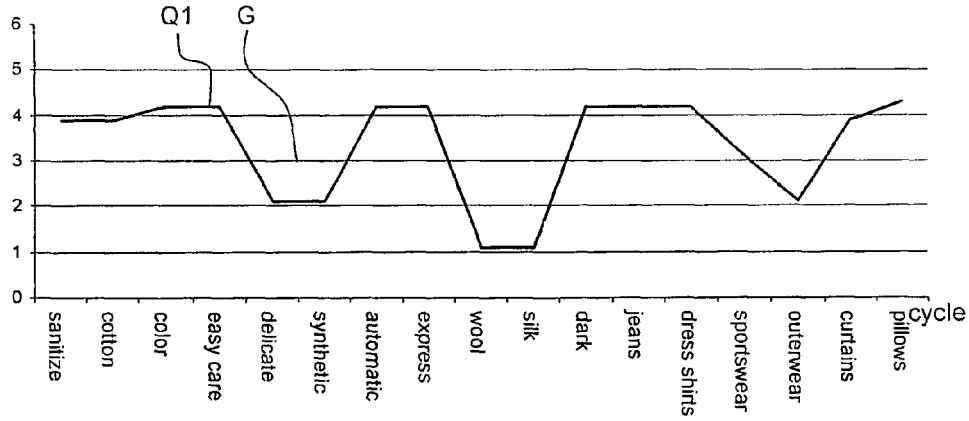

In FIG. 6, a set of suitability information Q1 for powdered detergent for wool is represented in a diagram. It can clearly be seen that this detergent is particularly suitable for the "wool" and "silk" wash cycles, since the suitability rating is about Q1=1 for these cycles. This detergent is still suitable also for the "delicates", "synthetics" and "outerwear" treatment cycles, for which the suitability rating is Q1=2. However, for all other wash cycles, this detergent is not sufficiently suitable, as is revealed by the suitability information Q1>3.

Suitability information Q2 is similarly provided for the second container; i.e., for liquid treating agent, such as liquid detergent for delicate fabrics, heavy-duty liquid detergent, liquid detergent for colored fabrics, and liquid detergent for wool, respectively.

What is claimed is:

1. A method for operating a dispensing system for a washing machine including a suds container for receiving wash liquid and at least one supply container for receiving a treating agent, the method comprising:

receiving a first treating agent in a first container of the at least one supply container;

receiving a second treating agent in a second container of the at least one supply container;

selecting and activating a wash or treatment cycle from a plurality of wash or treatment cycles using an input device;

evaluating suitability information of the first and second treating agents based on the selected wash or treatment cycle, the suitability information quantifying the suitability of the treating agents for the specific selected wash or treatment cycle, the suitability information including a respective suitability information value for the first treating agent corresponding to each of the plurality of wash or treatment cycles and a respective suitability information value for the second treating agent corresponding to each of the plurality of wash or treatment cycles;

comparing the respective suitability information value for the first treating agent corresponding to the selected wash or treatment cycle with the respective suitability information value for the second treating agent corresponding to the selected wash or treatment cycle;

selecting one of the first and second supply containers based on the comparison if the corresponding suitability information value reaches a threshold value and delivering the respective treating agent from the selected supply container to the suds container at a start of the activated wash or treatment cycle; and performing the activated wash or treatment cycle using a controller.

2. The method for operating a dispensing system as recited in claim 1, wherein the first treating agent and the second treating agent each include at least one of a detergent or a washing additive.

3. The method for operating a dispensing system as recited in claim 1, wherein the delivering the respective treating agent is not carried out automatically in response to the suitability information value being below the threshold value.

4. The method for operating a dispensing system as recited in claim 1, wherein each treating agent is one of a plurality of types of treating agents.

5. The method for operating a dispensing system as recited in claim 4, further comprising selecting and presetting a first set of suitability information for the first container of the at least one supply container based on the treating agent received therein.

6. The method as recited in claim 4, wherein the plurality of types of treating agents includes at least one of heavy-duty powdered detergent, powdered detergent for colored fabrics, powdered detergent for delicate fabrics, powdered detergent for wool, heavy-duty liquid detergent, liquid detergent for colored fabrics, liquid detergent for delicate fabrics, or liquid detergent for wool.

7. The method for operating a dispensing system as recited in claim 1, wherein the suitability information is modifiable.

* * * * *